US007459617B2

(12) United States Patent
Kim et al.

(10) Patent No.: US 7,459,617 B2
(45) Date of Patent: Dec. 2, 2008

(54) LOCKING BRIDGE

(75) Inventors: Dong Jin Kim, Seoul (KR); Hyung Bae Park, Seoul (KR); James Richard Rosenberg, Santa Cruz, CA (US); Richard Taylor Akers, Nashville, TN (US)

(73) Assignee: Gibson Guitar Corp., Nashville, TN (US)

( * ) Notice: Subject to any disclaimer, the term of this patent is extended or adjusted under 35 U.S.C. 154(b) by 232 days.

(21) Appl. No.: 11/330,711

(22) Filed: Jan. 12, 2006

(65) Prior Publication Data

US 2007/0157789 A1 Jul. 12, 2007

(51) Int. Cl.
*G10D 3/04* (2006.01)

(52) U.S. Cl. ..... 84/298; 84/299

(58) Field of Classification Search ..... 84/298, 84/299

See application file for complete search history.

(56) References Cited

U.S. PATENT DOCUMENTS 2,786,382 A * 3/1957 Melita ..... 84/298
2,886,355 A * 5/1959 Wurzel ..... 403/326
3,032,807 A * 5/1962 Lanius, Jr. ..... 16/97
3,221,847 A * 12/1965 Attwood ..... 403/408.1
3,299,737 A * 1/1967 Hurlin ..... 74/595
3,481,655 A * 12/1969 Campbell ..... 384/536
3,987,697 A * 10/1976 Wurzel ..... 411/353
4,008,642 A * 2/1977 Becker ..... 411/429
4,144,794 A * 3/1979 Silverman et al. ..... 84/327
4,230,014 A * 10/1980 Hoshino ..... 84/299
4,433,605 A * 2/1984 Matsui ..... 84/299
4,457,201 A * 7/1984 Storey ..... 84/313
4,688,461 A 8/1987 Stroh ..... 84/298
4,697,832 A * 10/1987 Dickirson ..... 285/319
4,733,987 A * 3/1988 Tomlinson et al. ..... 403/326
4,750,878 A 6/1988 Nix et al. ..... 384/296
4,804,290 A * 2/1989 Balsells ..... 403/326
4,886,408 A * 12/1989 Killian et al. ..... 411/519
5,221,111 A * 6/1993 Younger ..... 280/809
5,265,890 A * 11/1993 Balsells ..... 277/467
5,681,060 A * 10/1997 Berg et al. ..... 285/305
5,704,100 A * 1/1998 Swan ..... 24/656
5,806,898 A * 9/1998 Hollnagle ..... 285/86

(Continued)

OTHER PUBLICATIONS

A guitar bridge manufacturing by Gotoh, product No. 510UB. Applicant hereby admits this Gotoh product is prior art for applicant's invention. As depicted in Figs. 2A and 2B attached hereto.

(Continued)

*Primary Examiner*—Walter Benson
*Assistant Examiner*—Robert W Horn
(74) *Attorney, Agent, or Firm*—Stroock & Stroock & Lavan LLP

(57) ABSTRACT

Included herein is an instrument component for mounting to the body of an instrument having strings, for example a guitar. The instrument component comprises a plurality of attachment devices, an elongated bracket, and a biasing element. The elongated bracket includes a plurality of attachment apertures where each aperture includes a center and is shaped to accept one of the attachment devices. A biasing element is positioned in each attachment aperture wherein each biasing element engages one of the attachment devices. Each biasing element includes a plurality of protrusions wherein each protrusion biases the attachment device toward the center of the attachment aperture.

13 Claims, 7 Drawing Sheets

U.S. PATENT DOCUMENTS

| | | | | |
|---|---|---|---|---|
| 5,951,081 | A * | 9/1999 | Foster et al. | 295/36.1 |
| 6,280,335 | B1 * | 8/2001 | Wehner et al. | 464/130 |
| 6,613,968 | B1 * | 9/2003 | Devereaux et al. | 84/299 |
| 6,686,523 | B1 | 2/2004 | Devereaux et al. | 84/297 |
| D487,390 | S * | 3/2004 | Tanaka et al. | D8/354 |
| 6,837,815 | B2 * | 1/2005 | Meggiolan | 474/82 |
| 6,849,792 | B2 | 2/2005 | Yeakel | 84/298 |
| 6,870,083 | B2 | 3/2005 | Turner | 84/298 |
| 7,204,668 | B2 * | 4/2007 | Le | 411/353 |
| 7,226,233 | B2 * | 6/2007 | SuBenbach et al. | 403/143 |
| 2003/0230184 | A1 | 12/2003 | Devereaux et al. | |
| 2004/0074367 | A1 | 4/2004 | Devereaux et al. | |
| 2005/0150348 | A1 * | 7/2005 | Ito | 84/299 |
| 2007/0157789 | A1 * | 7/2007 | Kim et al. | 84/298 |
| 2007/0157790 | A1 * | 7/2007 | Kim et al. | 84/298 |

OTHER PUBLICATIONS

Guitar tailpiece manufactured by Gotoh, product name 510FA. Applicant hereby admits that this guitar tailpiece by Gotoh is prior art for applicant's invention as depicted in Figs. 3A and 3B attached hereto.

A guitar bridge manufactured by Gotoh, product No. 510UB. Applicant hereby admits this Gotoh product is prior art for applicant's invention. As depicted in Figs. 2A and 2B attached hereto, Jan. 12, 2006, figure 2a.

Guitar tailpiece manufactured by Gotoh, product name 510FA. Applicant hereby admits that this guitar tailpiece by Gotoh is prior art for applicant's invention as depicted in Figs. 3A and 3B attached hereto, Jan. 12, 2006, fig.2b.

* cited by examiner

LOCKING BRIDGE

BACKGROUND OF THE INVENTION

The present invention relates generally to stringed instruments. More specifically the present invention relates to securing an instrument component onto the body of a guitar independent of the strings of the guitar.

Generally, a stringed instrument 10, such as a guitar shown in FIG. 1, includes several components and features. These various features must be installed and aligned in order for the guitar to operate properly. Various portions of the guitar 10 include the neck 12 and body 14 and strings 16. The strings 16 are connected to the neck 12 at the head (not shown) and to the body 14 at the tailpiece 18. The tailpiece is normally positioned on pegs 20 extending from the guitar body 14. The strings 16 normally pass over the bridge 22 and are supported by the bridge 22. The bridge 22 normally includes apertures 24 that accept pegs 26 extending from the guitar body 14. In the case of an electrical guitar, the strings 16 then are spaced over one or more pickups 28 that collect the sound from the strings 16 to be processed through the electrical guitar. These pickups are used to convert the physical vibrations of the strings 16 into the electrical energy which then can be electrically amplified to increase the volume of the guitar 10.

The tension of the strings 16 as well as the size of the individual strings 16 provides the range of notes and the proper tone of the guitar 10. The strings 16 are stretched to a taunt tension from the tailpiece 18 to the head of the neck 12. Fine adjustments in the tension of the strings 16 can occur in order to tune the guitar with a proper tone and a timbre. This tuning process of the guitar can take a large amount of time and can be very tedious for even the most experienced guitar tuners. As previously discussed, it is the strings that provide the mechanical energy that ultimately produces the sound from the guitar 10. As such, it is important to have these strings in proper tune.

A detriment to the tension in these strings 16 is the fact that the strings 16 have a tendency to break during playing of the guitar 10. This necessitates a restringing of the guitar and additional tuning of those strings that are restrung. The connection between the tailpiece 18 and bridge 22 to the body 14 of the guitar 10 complicates this restringing process. Conventionally, the tailpiece 18 and bridge 22 have been held in place against the guitar body 14 only by the tension of the strings 16. As such when one of the guitar strings breaks, or the guitar is in need of maintenance or repair, such as a simple cleaning, the bridge 22 and/or tailpiece 18 can be moved out of alignment, or fall off the guitar entirely. This movement can necessitate the retuning of all of the strings 16 of the guitar 10. As such in conventional guitars, even the breaking of, or damage to, a single string 16 in the guitar 10 can necessitate a retuning of all of the strings 16.

There have been some prior art attempts to alleviate these issues. For example, U.S. Pat. Nos. 6,686,523 and 6,613,968 and U.S. Patent Application Publication Nos. 2003/0230184 and 2004/0074367 by Devereaux et al. disclose the use of set screws to threadably secure the bridge and tailpiece to the posts extending from the guitar body. These types of attachments of the bridge and tailpiece to the guitar body require special tools in order to facilitate the set screw attachment between the individual post and those guitar components. As such, without a special tool, maintenance, repair, and adjustment to the guitar are difficult.

Additionally, the Gotoh Company has manufactured tailpieces and bridges in an attempt to alleviate these problems. Namely, the Gotoh products named 510 UB and 510 FA, as depicted in FIGS. 2A-3B, include a single spring element used to retard entry and exit of a post in an opening in the bridge or tailpiece. These Gotoh bridges and tailpieces cannot completely secure the posts within these opening with the use of the spring elements. In fact the Gotoh 510 UB bridge specifically uses an additional set screw to secure the bridge in place relative to the post and guitar body. The set screw requires additional tools in order to operate. Alternately, the Gotoh 510 FA tailpiece has the post loose within the opening. This design does not secure the component to the body of the guitar such that damage to one or more strings will likely reposition or move the component necessitating the retuning of the entire guitar.

What is needed then is an improved system and method for securing instrument components to stringed instruments that preferably lacks the need for additional tools and reduces the allowance for relative movement between these components and the body of the stringed instrument.

BRIEF SUMMARY OF THE INVENTION

Included herein is an instrument component for mounting to the body of an instrument having strings, for example a guitar. The instrument component comprises a plurality of attachment devices, an elongated bracket, and a biasing element. The elongated bracket includes a plurality of attachment apertures where each aperture includes a center and is shaped to accept one of the attachment devices. A biasing element is positioned in each attachment aperture wherein each biasing element engages one of the attachment devices. Each biasing element includes a plurality of protrusions wherein each protrusion biases the attachment device toward the center of the attachment aperture.

In a preferred embodiment the biasing element is annular in shape and includes at least three protrusions spaced around the attachment aperture. Each protrusion can bias the attachment device towards the other protrusions and can press the attachment device against the other protrusions of the biasing element. The elongated bracket can further include a plurality of string supports positioned between the attachment apertures to engage the strings of the instrument.

Preferably each attachment device further includes a head, an anchor end located distal from the head, and an annular disk positioned between the head and the anchor. Each biasing element can engage the head of one of the attachment devices wherein the attachment aperture substantially encompasses the head of each attachment device. The elongated bracket can rest on the annular disk of the attachment devices. Additionally, the anchor end of each attachment device can be shaped to attach that attachment device and the elongated bracket to the body of the instrument.

Alternately the biasing element can include a first protrusion biasing the attachment device in a first direction and a second protrusion biasing the attachment device in a second direction such that the second direction is substantially opposite the first direction. In this embodiment, each attachment aperture can further include an internal wall such that each biasing element positioned in each attachment aperture can secure the attachment device against the internal wall of the attachment aperture.

It is therefore a general object of the present invention to provide instrument components that can be mounted to the body of a stringed instrument.

Another object of the present invention is to provide an instrument component that can be removeably fixed to the body of a stringed instrument independent of the strings of the stringed instrument.

Another object of the present invention is to provide an instrument component that can be removeably fixed to the body of a stringed instrument without the use of special tools.

Still another object of the present invention is to provide an instrument component for a stringed instrument that can retain its position during maintenance and repair to the stringed instrument.

Still another object of the present invention is to provide an instrument component including a biasing element that removeably fixes the instrument component to attachment devices that mount to the body of a stringed instrument.

Other and further objects, features and advantages of the present invention will be readily apparent to those skilled in the art upon reading of the following disclosure when taken in conjunction with the accompanying drawings.

DETAILED DESCRIPTION OF THE INVENTION

Figure 1:
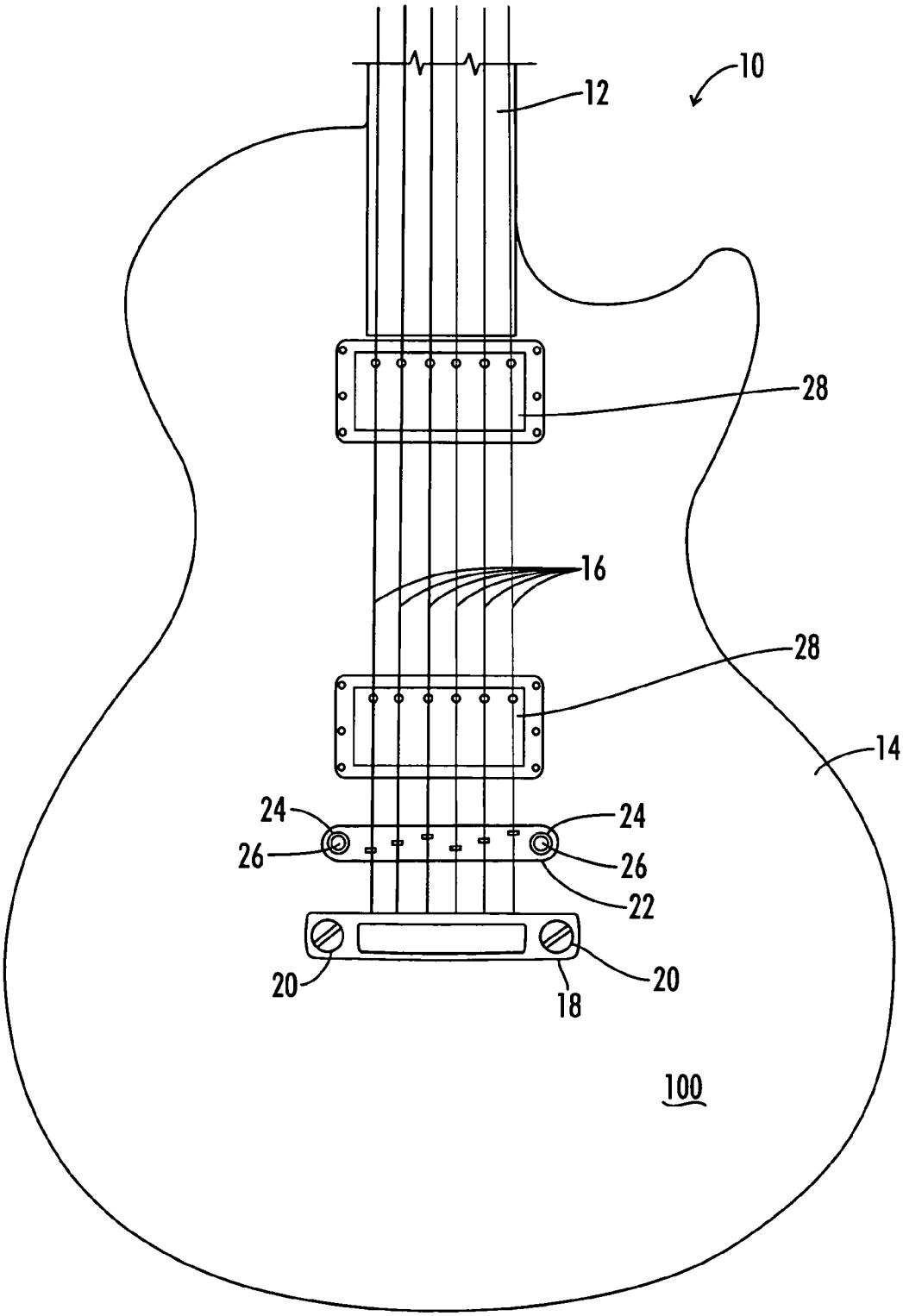
FIG. 1 is a partial front view of a conventional guitar body having standard instrument components.
Figure 2A:
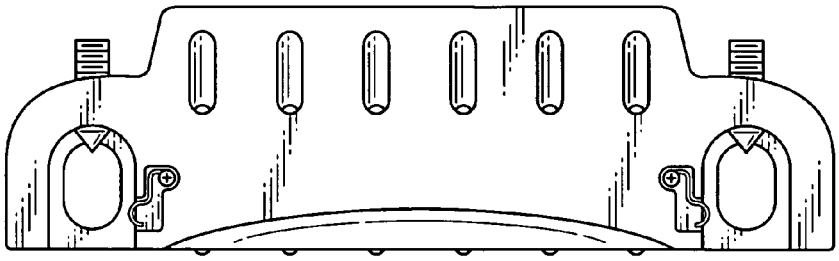
FIG. 2A (PRIOR ART)
FIG. 2A is a bottom view of the 510UB instrument component.
Figure 2B:
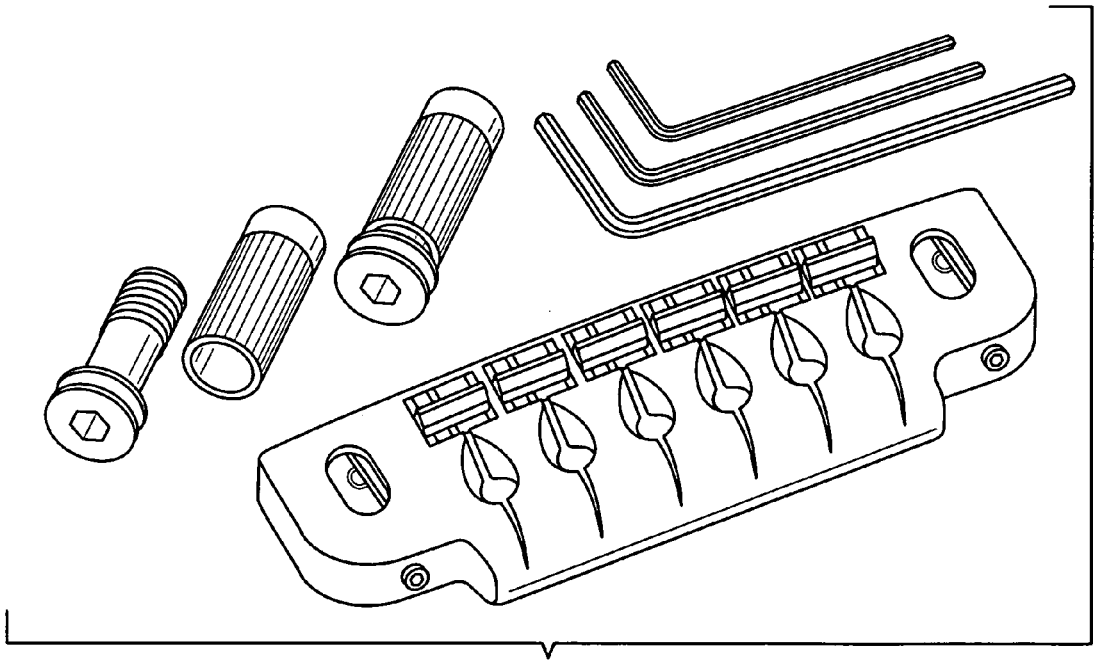
FIG. 2B (PRIOR ART)
FIG. 2B is a perspective view of the component of FIG. 2A.
Figure 3A:
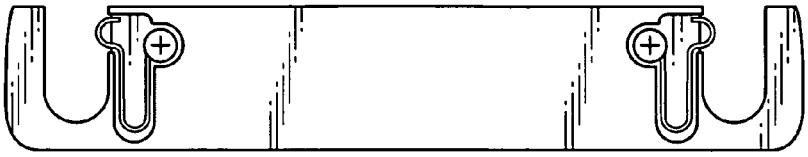
FIG. 3A (PRIOR ART)
FIG. 3A is a bottom view of the 510FA instrument component.
Figure 3B:
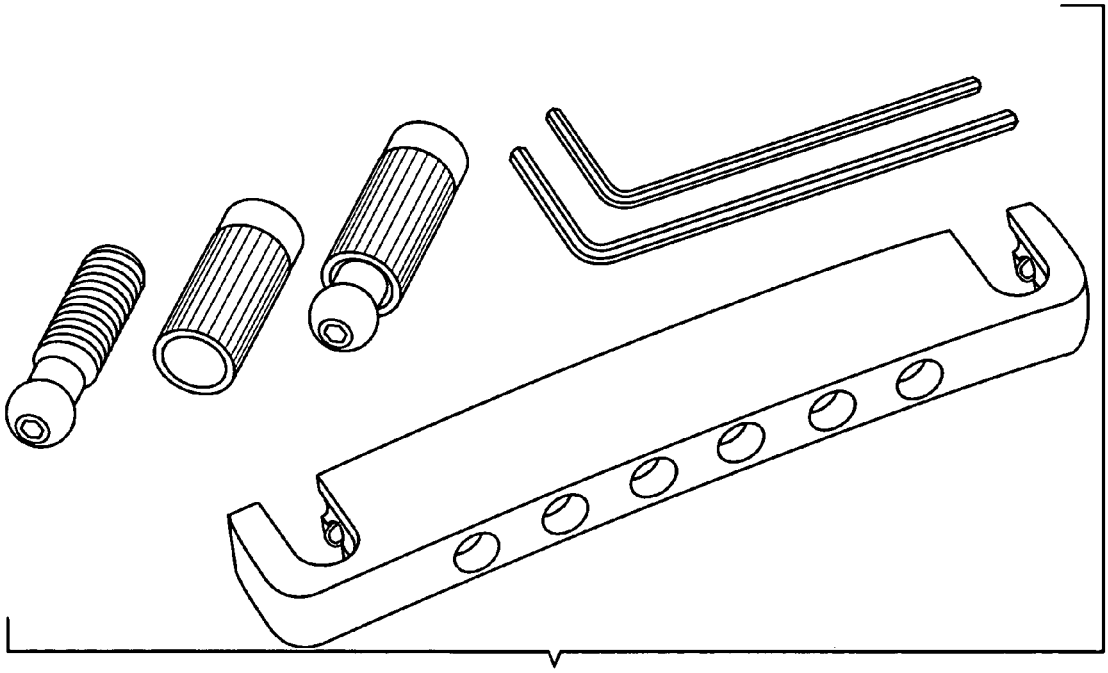
FIG. 3B (PRIOR ART)
FIG. 3B is a perspective view of the component shown in FIG. 3A.
Figure 4D:
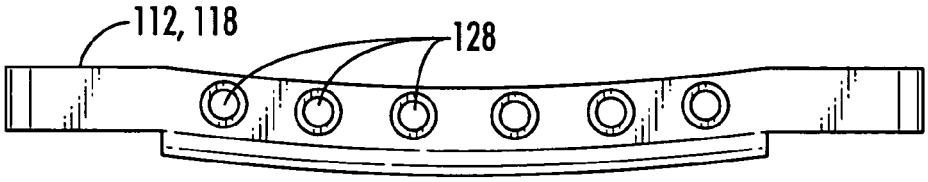
FIG. 4D is a back view of the instrument component shown in FIGS. 4A-C.
Figure 4C:
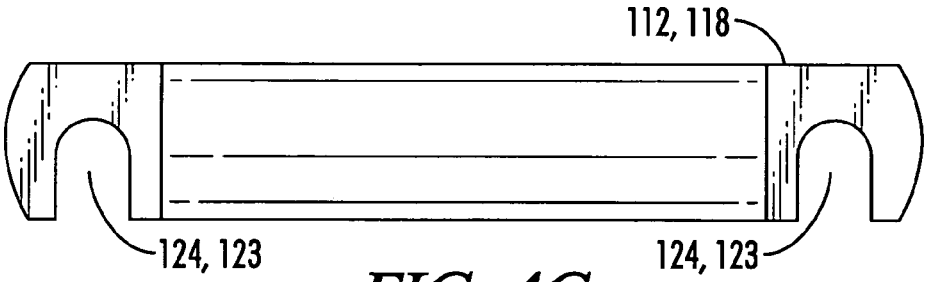
FIG. 4C is a top view of the instrument component of FIGS. 4A-B.
Figure 4B:
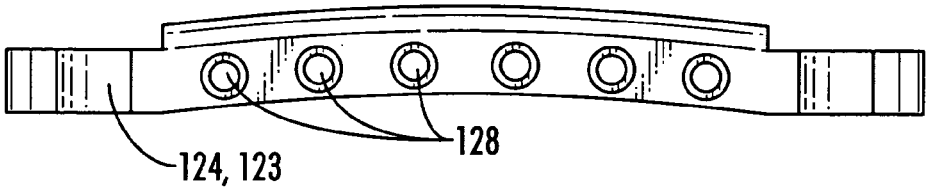
FIG. 4B is a front view of the instrument component of FIG. 4A.
Figure 4A:
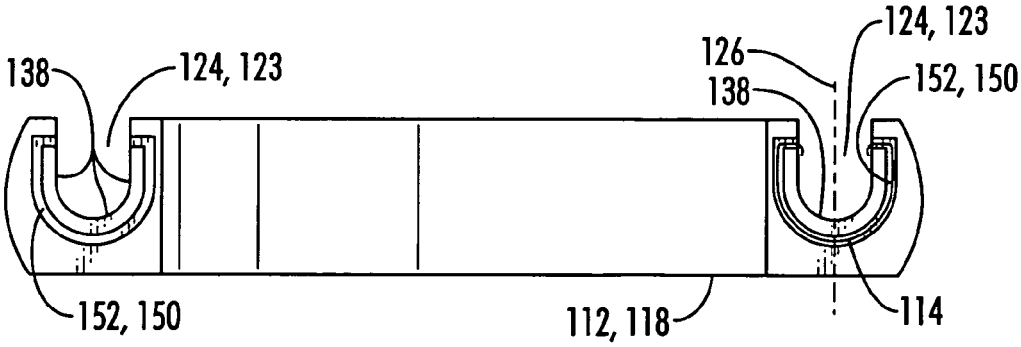
FIG. 4A is a bottom view of a first instrument component, namely a locking tailpiece, made in accordance with the current disclosure.
Figure 4E:
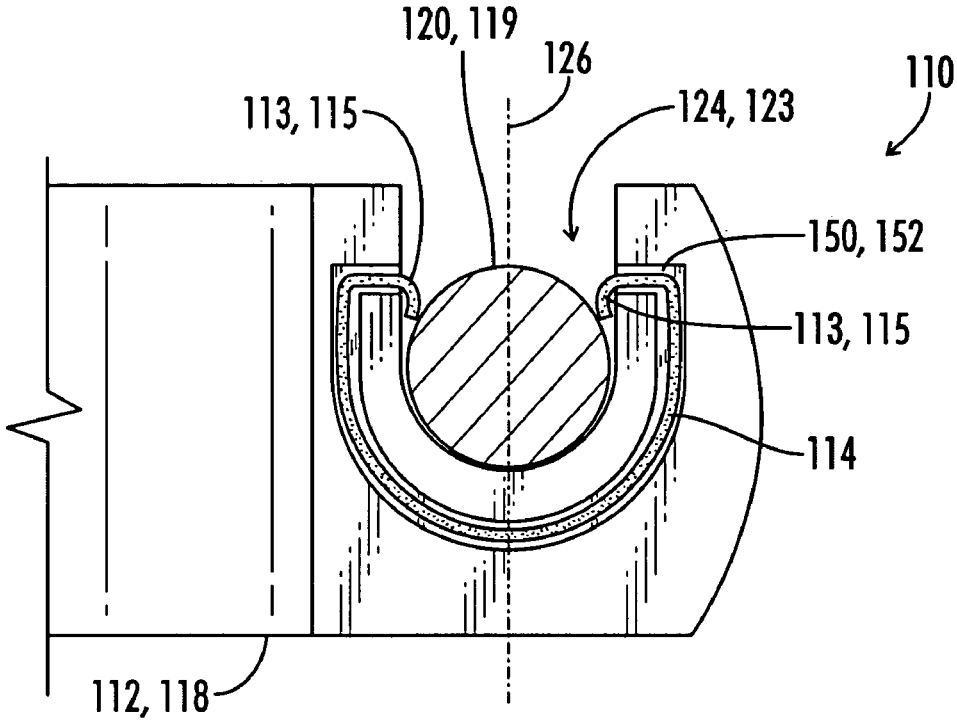
FIG. 4E is a partial detail view of the engagement between an attachment device and a biasing element in the attachment aperture for the instrument component shown in FIGS. 4A-4D.
Figure 5:
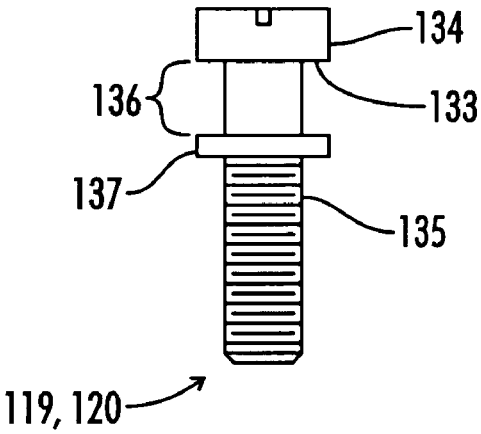
FIG. 5 is a side view of an attachment device made in accordance with the current disclosure.
Figure 6:
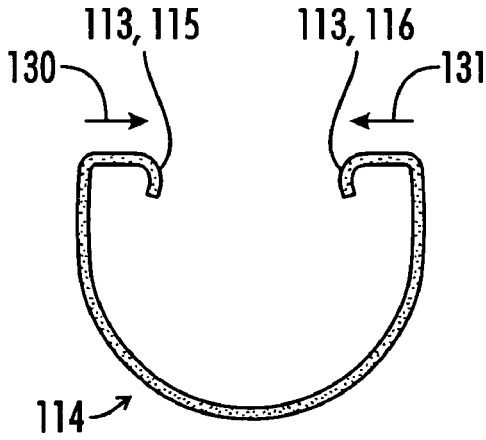
FIG. 6 is a bottom view of a biasing element made in accordance with the current disclosure.

Referring generally now to FIGS. 1-9, the present invention relates to an instrument component for an instrument 10 having strings 16. The instrument 10 can be described as a stringed instrument 10 or a guitar 10. The present invention is particularly applicable to electric guitars 10 and the instrument components, such as a bridge 22 and tailpiece 18, attached to the guitar body 14 on pegs, such as pegs 20 or 26.

Examples of an instrument component 110, such as an inventive bridge 122 or an inventive tailpiece 118, made in accordance with the current disclosure are generally shown in FIGS. 4A-9. The bridge 122 and tailpiece 118 include some similar features, such as the use of spring retainers with multiple biasing armatures. However, the bridge 122 and tailpiece 118 also include different features, such as the preferred configurations for the spring retainers and the vertical or horizontal acceptance of and engagement with the retaining posts 120 extending from the guitar body 14.

Locking Tailpiece

FIGS. 4A-6 illustrate a tailpiece 118, which may be generally referred to as an instrument component, for mounting to the body 14 of the stringed instrument 10. The tailpiece 118 comprises a plurality of tailpiece posts 119, which can also be described as attachment posts 119 or generally referred to as attachment devices 120, an elongated bracket 112 having a plurality of post openings 123, which can also be described generally as attachment apertures 124, and a biasing element 114 positioned in each post opening 123. Each post opening 123 is shaped to accept one of the tailpiece posts 119. Each biasing element 114 engages one of the tailpiece posts 119 to secure the elongated bracket 112 to the tailpiece posts 119. Each biasing element 114 can include a plurality of protrusions 113. A first protrusion 115 biases the tailpiece post 119 in a first direction 130 and a second protrusion 116 biases the tailpiece post 119 in a second direction 131. Preferably the second direction 131 is substantially opposite the first direction 130.

Additionally each post opening 123 can include a center axis 126 wherein each protrusion 113 biases the tailpiece post 119 positioned in that post opening 123 towards the center axis 126 of that post opening 123. The protrusions 113 can also bias the tailpiece post 119 towards the other protrusions. Each post opening 123 can include a recessed portion 150 shaped to accept the biasing element 114.

The tailpiece 118 further includes a plurality of string holes 128, which can be generally referred to as string apertures 128, positioned between the post openings 123 to accept the strings 16 of the guitar 10. The string holes 128 are used to anchor one end of the strings 16 to the body 14 of the guitar 10 through the removably fixed attachment between the tailpiece 118 and the tailpiece posts 119, wherein the tailpiece posts 119 are fixed to the body 14 of the guitar 10.

The tailpiece posts 119 preferably include a head 134, an anchor 135 located distal from the head 134, and a connection gap 136 positioned between the head 134 and anchor end 135. Each biasing element 114 engages the connection gap 136 of one of the tailpiece posts 119. Additionally each post opening is shaped to accept the connection gap 136, which can also be described as a neck 136, of one of the tailpiece posts 119. The head 134 of each tailpiece post 119 can extend above the tailpiece 118 while the anchor end 135 of each post 119 is shaped to attach that post 119 and a particular end of the tailpiece 118 to the body 14 of the instrument 10. The head 134 of each post 119 can include a bottom face 133 while each anchor end 135 can include an annular ring 137 such that the connection gap 136 is defined between the bottom face 133 and the annular ring 137.

Preferably the biasing element 114, which can be described as a spring or a spring retainer, substantially conforms to the shape of the post opening 123. Additionally, in this embodiment the biasing element 114 is preferably arcuately shaped or can be substantially "c" shaped. Each post opening 123 can include an internal wall 138 wherein each biasing element 114 in one of the post openings 123 secures one of the posts 119 against the internal wall 138. This can be best illustrated in FIG. 4E where the first and second protrusions 115 and 116 of the biasing element 114 press towards the center axis 126 and engage the connection gap 136 and press the connection gap 136 of the post 119 towards the inner wall 138 of the post opening 123.

The post opening 123 of the tailpiece 118 can include a recessed groove 152 shaped to accept the biasing element 114 used to engage the post 119 in the post opening 123 of the tailpiece 118. This recessed groove 152 substantially mirrors the shape of the biasing element 114 used to engage the tailpiece post 119 to the tailpiece 118 within the post opening 123.

Locking Bridge

FIGS. 7A-9 illustrate a bridge 122, which can be described as an elongated string support bracket 122 or a string bridge 122. The bridge 122, which can generally be referred to as an instrument component, includes a plurality of bridge posts 121, which can be generally referred to as attachment devices, and biasing elements 114. The bridge 122 includes post openings 125, which can also be described generally as attachment apertures, wherein each post opening 125 includes a center 127 and is shaped to accept one of the bridge posts 121. Each biasing element 114 is positioned in one of the post openings 125 and engages one of the posts 121. Each biasing element 114 can include a plurality of protrusions 113 wherein each protrusion 113 biases the post 121 towards the center 127 of the post opening 125.

Figure 8A:
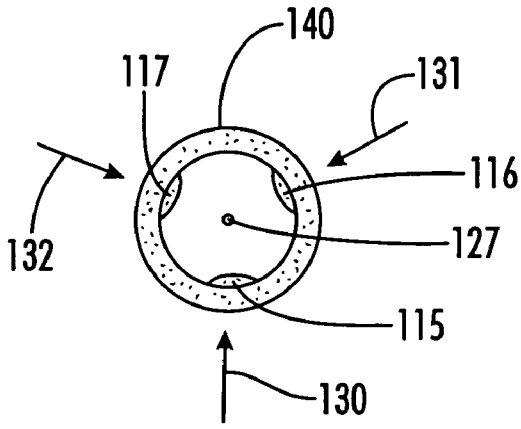
FIG. 8A is a top view of a biasing element made in accordance with the current disclosure.
Figure 8B:
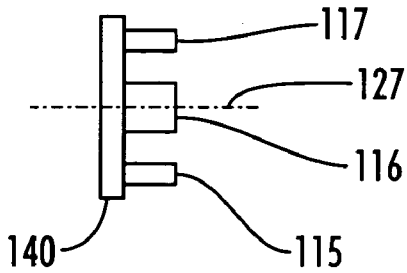
FIG. 8B is a side view of the biasing element shown in FIG. 8A.
Figure 9:
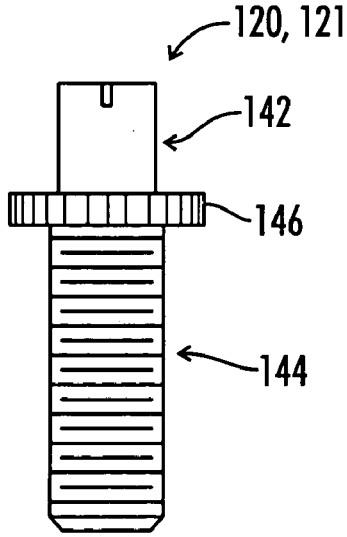
FIG. 9 is a side view of an attachment device made in accordance with the current disclosure.

Preferably the biasing element 114, which can be described as a spring or a spring retainer, is annular in shape, as can best be seen in FIGS. 8A-8B. The biasing element 114 includes first, second and third protrusions 115, 116, and 117 spaced around the post opening 125. These protrusions 115-117 preferably bias the posts 121 towards the other protrusions 115-117. The protrusions 115-117 of the biasing element 114 can also press the post 121 against the other protrusions 115-117 of that particular biasing element 114.

The bridge 122 can include string supports 129 positioned between the post openings 125 to engage the strings 16 of the guitar 10. The string supports 129 can be conventional string supports known in the art to be positioned on a bridge 22 for a guitar 10.

As best seen in FIGS. 8A-8B, in this embodiment the biasing element 114 preferably includes an annular rim 140 such that the protrusions 115-117 extend from the annular rim 140. The protrusions 113, which can also be described as engagement portions 113, are preferably separated protrusions extending from the annular ring 140, which can also be described as an internal rim 140.

Each bridge post 121 can include a head 142, an anchor end 144 located distal from the head 142 and an annular disk 146 positioned between the head 142 and annular disk 146. Each biasing element 114 can engage the head 142 of the bridgepost 121 while the post openings 125 and the bridge 122 can substantially encompass the head 142 of the bridgepost 121. The bridge 122 can rest on the annular disk 146 of the bridgepost 121. Additionally, the anchor end 144 of the bridgepost 121 is shaped to attach the bridgepost 121 and the bridge 122 to the body 14 of the instrument 10.

Figure 7A:
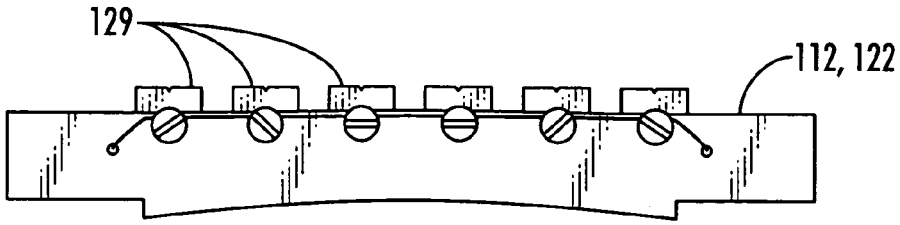
FIG. 7A is a front view of a second instrument component, namely a locking bridge, made in accordance with the current disclosure.
Figure 7B:
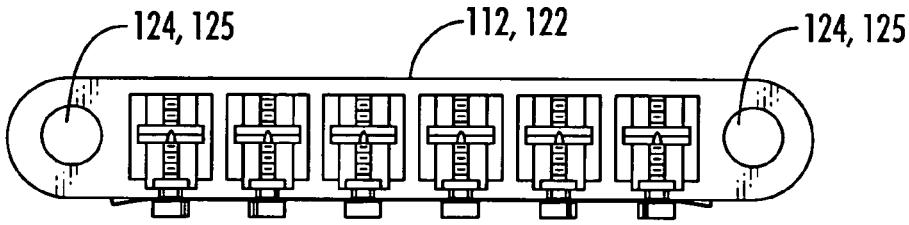
FIG. 7B is a top view of the instrument component shown in FIG. 7A.
Figure 7C:
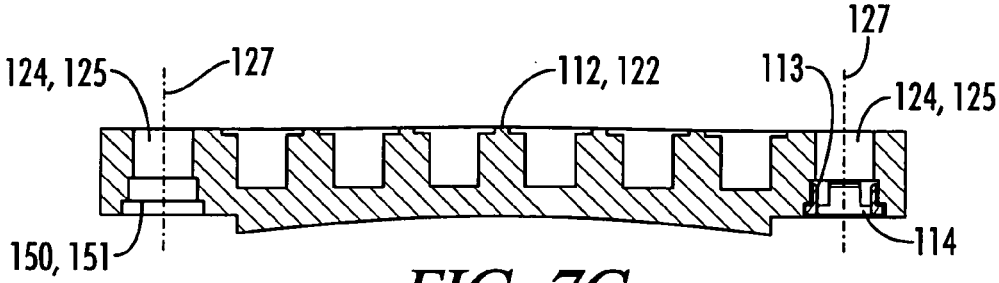
FIG. 7C is a cross sectional view taken along line 7C-7C in FIG. 7B. The string supports and adjustment screws have been removed for ease of illustration.
Figure 7D:
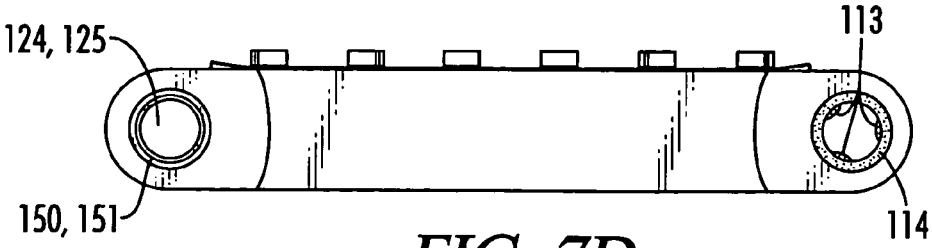
FIG. 7D is a bottom view of the instrument shown in FIG. 7A-C.
Figure 7E:
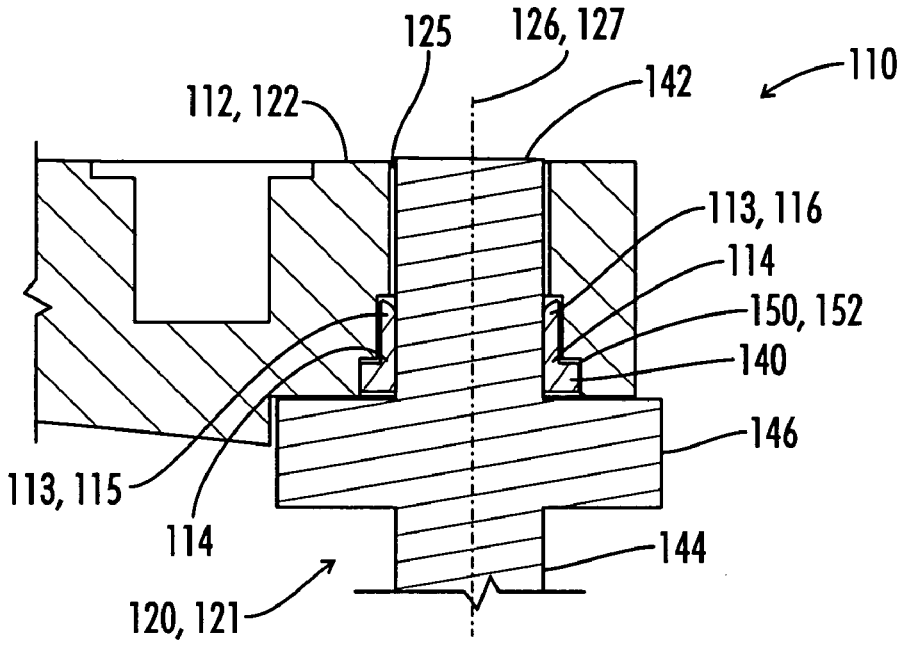
FIG. 7E is a partial detail cross-sectional view of the engagement between an attachment device and biasing element in an attachment aperture of the instrument component shown in FIGS. 7A-7D.

As best seen in FIG. 7E the protrusions 113 engage the bridgepost 121, and more specifically the head 142 of the bridgepost 121 within the post openings 125 of the bridge 122. These protrusions 113 bias the head 142 of the bridgepost 121 towards the center 127 of the post opening 125.

The post opening 125 of the bridge 122 can include a groove 151 shaped to accept the biasing element 114 used to engage the bridgepost 121 and the post opening 125. This groove 151 substantially mirrors the annular shape of this biasing element 114.

Thus, although there have been described particular embodiments of the present invention of a new and useful Locking Bridge, it is not intended that such references be construed as limitations upon the scope of this invention except as set forth in the following claims.

What is claimed is:

1. An instrument component for mounting to the body of an instrument having strings, the component comprising:

a plurality of attachment devices;

an elongated string support bracket having a plurality of attachment apertures, each attachment aperture shaped to accept one of the attachment devices and including a center; and an annular resilient biasing element positioned in each attachment aperture, each biasing element engaging one of the attachment devices and including at least three protrusions spaced around the attachment aperture, each protrusion resiliently biasing the attachment device toward the center of said attachment aperture.

2. The apparatus of claim 1, wherein each protrusion biases the attachment device toward the other protrusions.

3. The component of claim 1, wherein the elongated string support bracket further includes a plurality of string supports positioned between the attachment apertures to engage the strings of the instrument.

4. The component of claim 1, each attachment device further including a head, an anchor end located distal from the head, and an annular disk positioned between the head and the anchor end.

5. The component of claim 4, wherein each biasing element engages the head of one of the attachment devices.

6. The component of claim 5, wherein the attachment aperture is circular and substantially encompasses the head of each attachment device.

7. The component of claim 4, wherein the elongated string support bracket rests on the annular disks of the attachment devices.

8. The component of claim 4, wherein the anchor end of each attachment device is shaped to attach said attachment device and the elongated string support bracket to the body of the instrument.

9. The apparatus of claim 1, wherein each protrusion of the biasing element presses the attachment device against another protrusion of said biasing element.

10. An instrument component for mounting to the body of an instrument having strings, the component comprising:

a plurality of attachment devices;

an elongated string support bracket having a plurality of attachment apertures, each attachment aperture shaped to accept one of the attachment devices and including a center; and an annular biasing element positioned in each attachment aperture, each biasing element engaging one of the attachment devices and including at least three resilient protrusions spaced around the attachment aperture, each protrusion positioned to resiliently bias the attachment device toward the other protrusions of said biasing element.

11. The apparatus of claim 10, each protrusion biasing said attachment device toward the center of said attachment aperture.

12. An instrument component for mounting to the body of an instrument having strings, the component comprising:

a plurality of attachment posts;

a string bridge including a plurality of attachment openings, a plurality of string supports positioned between the attachment openings to engage the strings of the instrument, and a center axis positioned in each attachment opening, each attachment opening shaped to accept one of the attachment posts; and an annular resilient biasing element positioned in each attachment opening, each annular resilient biasing element engaging one of the attachment posts and including an internal rim and a plurality of resilient projections extending from the internal rim, each projection positioned to resiliently bias said attachment post toward the other projections of said biasing element and toward the center axis of the attachment aperture.

13. The component of claim 12, each attachment post further including a head, an anchor end located distal from the head, and an annular disk positioned between the head and the anchor end, wherein each biasing element substantially encompasses the head of one of the attachment posts.

* * * * *